US007926495B2

(12) United States Patent
Gilg et al.

(10) Patent No.: US 7,926,495 B2
(45) Date of Patent: Apr. 19, 2011

(54) MOLD CLEANING DEVICE

(75) Inventors: Franz Xaver Gilg, Polling (DE); Sven Droste, Herrsching (DE)

(73) Assignee: Weckerle GmbH, Weilheim (DE)

( * ) Notice: Subject to any disclaimer, the term of this patent is extended or adjusted under 35 U.S.C. 154(b) by 990 days.

(21) Appl. No.: 11/388,395

(22) Filed: Mar. 24, 2006

(65) Prior Publication Data

US 2006/0213540 A1 Sep. 28, 2006

(30) Foreign Application Priority Data

Mar. 24, 2005 (EP) ..... 05006487

(51) Int. Cl.
*B08B 9/02* (2006.01)
*B08B 5/02* (2006.01)

(52) U.S. Cl. ..... 134/197; 134/198; 134/167 R

(58) Field of Classification Search ..... 134/104.2, 134/105, 166 C, 166 R, 167 R, 197, 198; 15/300.1, 302, 304; 34/61, 64
See application file for complete search history.

(56) References Cited

U.S. PATENT DOCUMENTS

| | | | | | |
|---|---|---|---|---|---|
| 1,492,878 | A | * | 5/1924 | Eklundh | 137/104 |
| 1,492,924 | A | * | 5/1924 | Knight | 134/5 |
| 1,492,949 | A | * | 5/1924 | Allison | 15/304 |
| 4,051,878 | A | * | 10/1977 | Ohmeis et al. | 141/82 |
| 5,072,747 | A | * | 12/1991 | McCoy et al. | 134/48 |
| 5,609,171 | A | | 3/1997 | Kuo | |

FOREIGN PATENT DOCUMENTS

| | | |
|---|---|---|
| EP | 0567044 A1 | 10/1993 |
| GB | 1044963 | 6/1963 |
| GB | 1131595 | 10/1967 |

* cited by examiner

*Primary Examiner* — Frankie L Stinson
*Assistant Examiner* — Saeed T Chaudhry
(74) *Attorney, Agent, or Firm* — Howard & Howard Attorneys PLLC

(57) ABSTRACT

Device (1) for mold cleaning, in particular for molds (2) which are used to produce lipstick leads, wherein said device (1) comprises means (3) for inserting steam into said mold (2) to be cleaned and means (4) for collecting said steam and, where applicable, residues from said mold (2) to be cleaned as well as a corresponding method and a molding apparatus for molding materials with a corresponding mold cleaning device.

7 Claims, 3 Drawing Sheets

MOLD CLEANING DEVICE

FIELD OF THE INVENTION

The present invention relates to a device for cleaning molds, in particular for molds which are used to produce lipstick leads, as well as a corresponding method and a mold apparatus for molding materials with a corresponding cleaning device.

BACKGROUND OF THE INVENTION

For the production of lipstick leads in a mold apparatus at first the lipstick material is filled in a mold in a hot and liquid condition by means of a filling device. In a cooling area, the material is then cooled down until it is sufficient rigid. After that, the cooled down material is removed from the mold by means of a demolding device. For this, different kinds of molds can be used, which operate according to different principles. At the blow out mold, the molded material is blown out of the mold by means of an air jet. The sliding out mold comprises a sliding out piston with which the molded material can be slid out of the mold. If flexible molds are used, at first the molds will be extended and then the molded material is removed, for example, by means of a gripper.

In general, there is the possibility that during the demolding remains or residues, respectively, of the molded material remain in the mold, which may substantially deteriorate the quality of the subsequent produced lipstick leads. So far, in the prior art there is no possibility to prevent this. So far, only a manual cleaning could be carried out. For example, the molds were cleaned during the stand-still of the mold apparatus by means of cotton swabs. Alternatively, the sliding out piston of a sliding out mold or the complete mold are manually disassembled out of the mold apparatus and are cleaned in an ultrasonic bath. However, these cleaning procedures are very time consuming and labour intensive and are not suitable to remove the remains directly after their remaining in the mold.

SUMMARY OF THE INVENTION

Therefore, the object of the present invention is to provide a device for mold cleaning, a corresponding method and a mold apparatus with a corresponding cleaning device, with which the molds of the mold apparatus may be cleaned easily and quick.

According to the invention, the object is solved by a device for mold cleaning according to independent claim 1 and by a mold apparatus according to independent claim 4.

The device for mold cleaning, in particular for molds which are used to produce lipstick leads, comprises various means for that. Among other things, this is means for inserting steam into the mold to be cleaned. With the steam, where applicable, existing residues of a preceding mold process are detached from the mold wall. Furthermore, the device for cleaning—cleaning device—comprises means for collecting. With this means for collecting, the steam inserted by the means for inserting together with the maybe existing residues are collected. Thus, the residues can be easily and quick removed out of the mold.

The steam comprises preferably a pressure of at least 3 bar. In a further preferred embodiment, the steam comprises a pressure of at least 5 bar. During inserting into the mold to be cleaned, the steam preferably has a temperature of at least 100 degrees Celsius, wherein in a more preferred embodiment the steam has a temperature of 140 degrees Celsius. For example, the steam is provided by a separate steam producer, which preferably has a performance of at least 15 kW. In a further preferred embodiment, at least to a part of the steam a fat solvent is added in order to enable a quicker cleaning of the mold.

According to a preferred embodiment of the present invention, the means for inserting of the steam is located at the upper opening of the mold to be cleaned. Thus, the steam is inserted into the mold through the upper opening of the mold. The nozzle out of which the steam escapes, may end directly at the opening or in the lower part of the mold. In particular it is preferred to locate the opening of the nozzle beneath the opening of the mold. At this, the nozzle opening may be located, for example, 3 to 10 mm beneath the opening of the mold, more preferred it is a location of 5 mm (+/−1 mm) beneath the opening of the mold. The nozzle comprises preferably an opening with an inner diameter in the dimension of 3 to 10 mm, more preferred in the dimension of 4 to 6 mm.

The means for collecting maybe located at an upper opening of said mold. At this, the means for collecting are preferably located annular around the means for inserting.

Preferably, the means for collecting the steam is located at an opening in a lower part of the mold to be cleaned. This opening may be formed by sliding out a sliding out piston of a sliding mold. At a blow out mold, the opening maybe the blow-out opening.

Due to this arrangement, a current is caused in the mold with which the remains or residues, respectively, can easily be detached from the mold and removed out of the mold with the aid of the steam.

In a further preferred embodiment of the invention, immediate after the cleaning of the mold with the aid of the steam, hot air is blown into the steam in order to speed up the drying of the mold. Alternatively, a so-called pour crown heating may be used for that.

According to the inventive method for mold cleaning, in particular for molds which are used to produce lipstick leads, steam is inserted into the mold to be cleaned and collected, where applicable, together with residues from the mold to be cleaned.

The molding apparatus according to the invention for molding materials by using at least one mold comprises at least one filling device and at least one demolding device. With the aid of filling device, the liquid and mostly heated material is filled in the respective molds. The demolding device enables to remove the formed material out of the mold. The filling device and the demolding device are preferable capable to fill-in and to demold several molds at the same time.

In the time period between the filling-in into the mold and the demolding out of the mold the liquid material in the mold becomes more rigid in order to form, for example, a lipstick lead. This process can be controlled by various devices and, where applicable, also speeded up. For example, there is a possibility to provide in the area around the mold a chamber in which a cooling fluid maybe pumped.

According to the invention, the molding apparatus also comprises a device for mold cleaning. This mold cleaning device comprises means for inserting steam into the mold to be cleaned and means for collecting steam and, where applicable, residues from the mold to be cleaned. As explained in connection with the mold cleaning device, the means maybe located at various positions. For example, one means or two means may be located at the upper opening of the mold or in the mold. Alternatively, at least one means may be located at an opening in the lower part of the mold.

In the molding apparatus the molds and the filling device are preferably located such that the molds move from the filling device to the demolding device and from there again to the filling device. The mold cleaning device is preferably located with respect to the moving direction of the molds after the demolding device and before the filling device. In general, the mold cleaning device can also be located at different positions in the molding apparatus. For example, due to the space conditions, it may be appropriate to locate the mold cleaning device before the demolding device.

With the aid of the mold cleaning device according to the invention the mold cleaning method according to the invention and the molding apparatus according to the invention a quick and easy cleaning of the mold is enabled the first time. A manual cleaning or a manual disassembling of the molds is not necessary anymore. With the aid of the invention, molds can be cleaned in such a short time period, that in general the cleaning can take place between the demolding and before the mold is filled again. Thus, the material to be formed can each time be filled in a recently cleaned and dry mold without extending the production process. With the aid of the mold cleaning device according to the invention the molds of the molding apparatus can also be cleaned when the molding apparatus is not used for forming materials.

BRIEF DESCRIPTION OF THE DRAWINGS

In the following, examples of embodiments of the invention are described by means of the accompanying drawings, in which.

DETAILED DESCRIPTION OF THE PREFERRED EMBODIMENT

Figure 1:
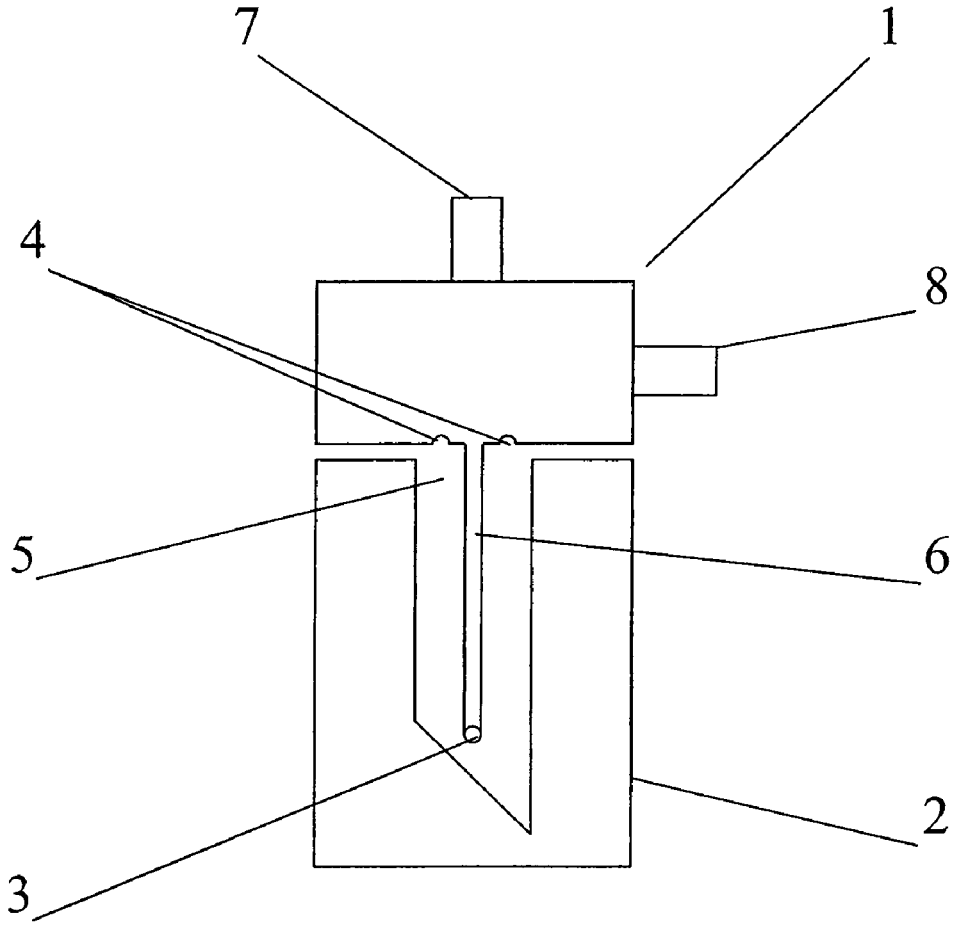
FIG. 1 shows one embodiment of the mold cleaning device according to the invention.

FIG. 1 shows exemplary one embodiment of the mold cleaning device 1 according to the invention together with a mold 2 to be cleaned. This mold cleaning device 1 comprises means 3 for inserting steam and means 4 for collecting steam and, where applicable, residues. In the present embodiment, the mold cleaning device 1 is realized as one part. This one part mold cleaning device 1 is located over the upper opening 5 of the mold 2 and preferably closes this opening air tight (not shown). The means 3 for inserting steam and the means 4 for collecting of steam and the residues can respectively be formed by openings in the mold cleaning device 1. In the embodiment shown in FIG. 1, the mold cleaning device 1 comprises at least two openings 3, 4. The first opening 3 of the mold cleaning device 1 is the means for inserting and is used according to the invention in order to insert steam into the mold 2. The second opening 4 of the mold cleaning device 1 is the means for collecting and is used according to the invention in order to collect the steam, where applicable, together with the residues. In the embodiment shown in FIG. 1, the opening 3 is located at a nozzle 6 which reaches close to the bottom of the mold 2.

With the aid of the mold cleaning device 1 according to the invention, a quick and easy cleaning of the molds 2 is possible. The steam, which is inserted at the bottom of the mold 2 to be cleaned by the means 3 for inserting, spreads in the mold 2, circulates around the walls and removes where applicable residues from the walls of the mold. With the aid of the means 4 for collecting, the steam, where applicable, together with residues, are re-collected, and removed out of the then cleaned mold 2.

In the embodiment shown in FIG. 1, the opening 4 is formed as a kind of ring which extends around the means 3 for inserting. Thus, a uniformly collecting of the steam can be ensured. Alternatively, several openings can be located around the means for inserting.

In the present embodiment, the mold cleaning device 1 comprises two sockets 7, 8 wherein via the one socket 7 the steam is fed into the mold cleaning device 1 and via the second socket 8 the steam from the mold 2, where applicable, together with residues is removed from the mold cleaning device 1. At the second socket 8, for example, an exhauster for exhausting of the steam may be connected.

Figure 2:
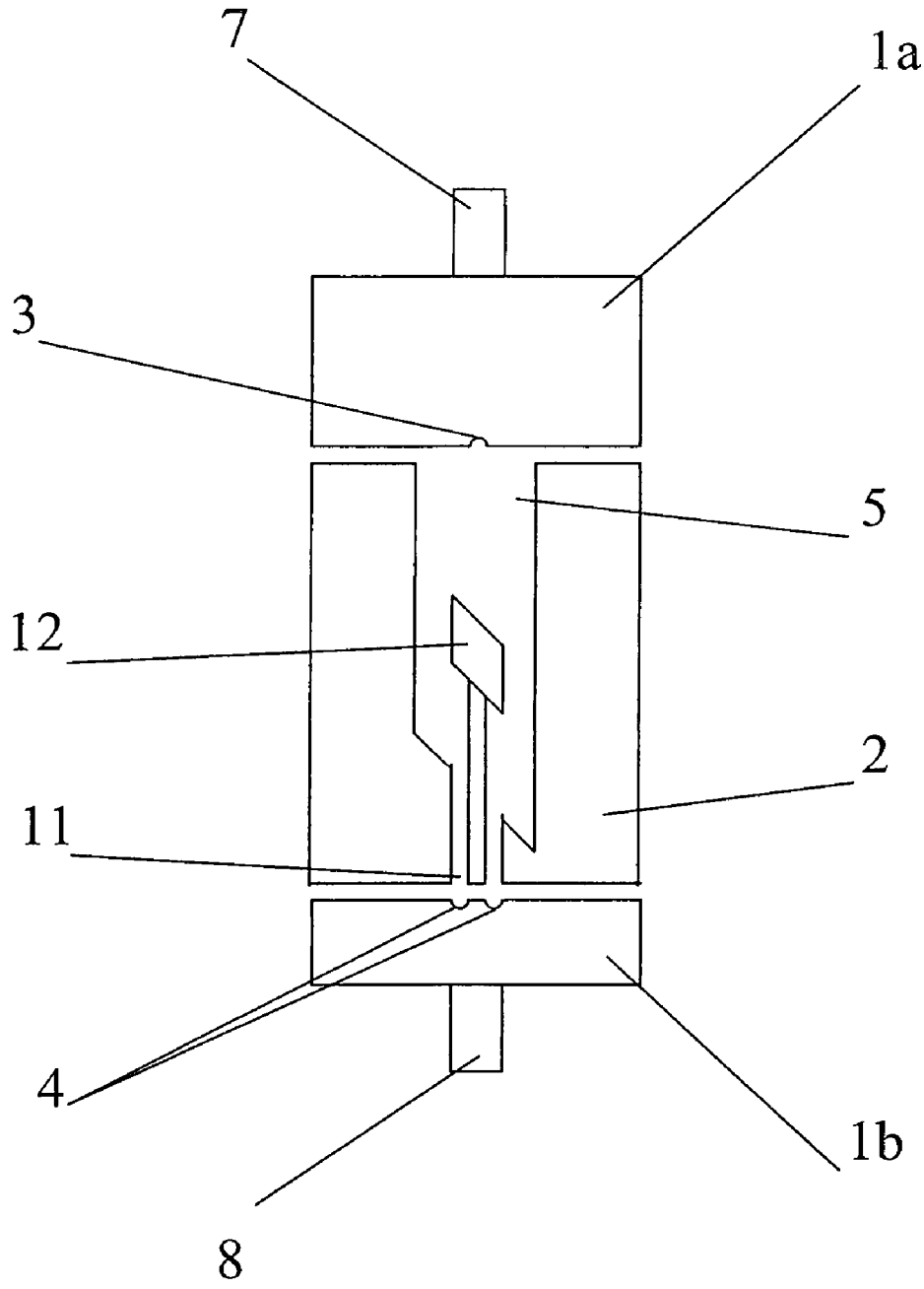
FIG. 2 shows a further embodiment of the mold cleaning device according to the invention in which a sliding mold is used.

FIG. 2 shows an alternative embodiment of the mold cleaning device 1 according to the invention. This mold cleaning device 1 utilize that, for example at a sliding out mold, there is the possibility to provide an opening 11 in the lower part of the mold 2. This opening is formed, when—as visible in FIG. 2—the sliding out piston 12 is slid out into the mold 2.

In this embodiment, the mold cleaning device 1 is divided into two parts 1*a*, 1*b*. In the one part 1*a* the means 3 for inserting as well as the socket 7 via which the steam is fed to the mold cleaning device 1 are located. In the second part 1*b*, the means 4 for collecting and the socket 8 via which the steam where applicable together with residues is removed from the mold cleaning device are located. Both parts are preferably located airtight at the mold 2 (not shown).

With this arrangement a flowing through the mold 2 with the steam is enabled by which the remains and residues from the walls and, where applicable, from the sliding out piston 12 are detached and with the aid of the steam removed out of the mold.

In the exemplary embodiments shown in FIGS. 1 and 2, there is the possibility to exchange the arrangement of the means 3 for inserting and the means 4 for collecting.

Figure 3:
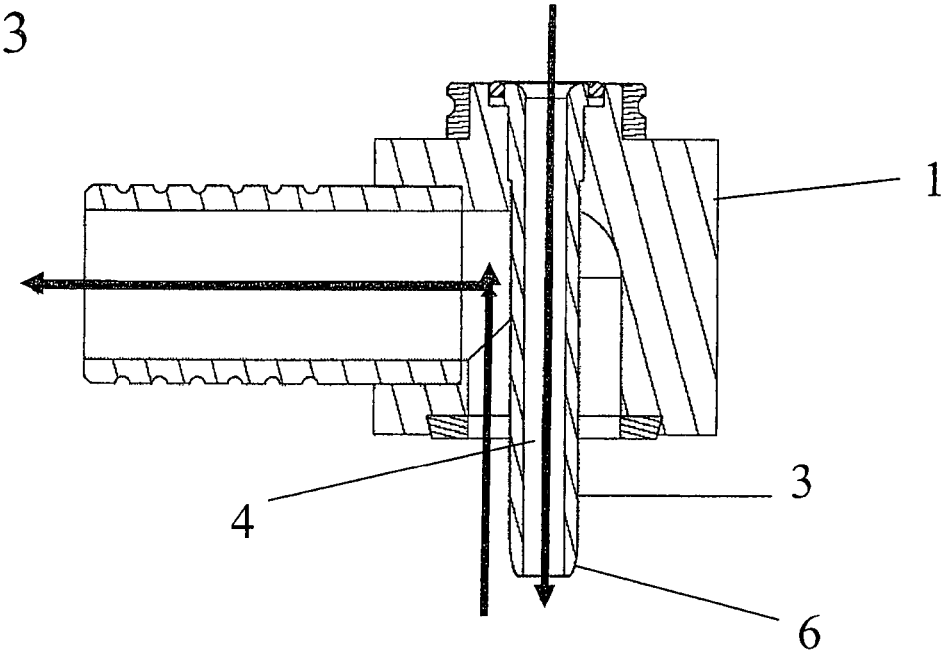
FIG. 3 shows a cross-section through the embodiment of the mold cleaning device according to the invention in FIG. 1.

FIG. 3 shows a cross-section through the embodiment of the mold cleaning device 1 according to the invention as shown in FIG. 1. A first arrow shows the way of the steam through the means 3 for inserting and the nozzle 6 attached thereto. By the means 4 for collecting, the steam, where applicable, together with existing residues is removed out of the mold along the there shown arrows.

Figure 4:
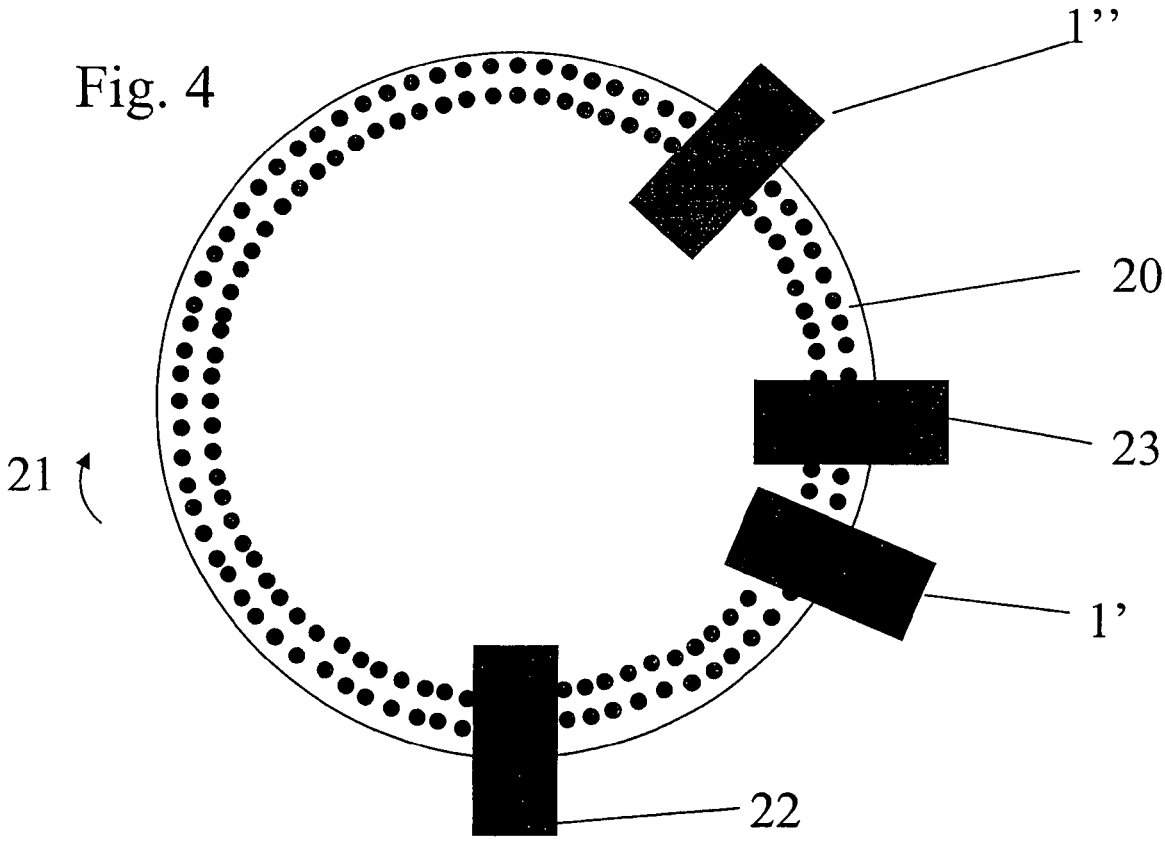
FIG. 4 shows the location of the mold cleaning device in the molding apparatus according to the invention.

FIG. 4 shows a top view on a pour crown 20 as it may be used in connection with the present invention. With this pour crown 20, the molds 2 move in the direction represented by the arrow 21. Thereby, the molds 2 are firstly filled with the material to be formed with the aid of the filling device 22 and after the cooling (not shown) demolded out of the mold 2 with the aid of the demolding device 23. In FIG. 4, two alternative arrangements for the mold cleaning device 1 according to the invention are shown. In a first embodiment, the mold cleaning device 1' is located with respect to the moving direction of the mold 2 after the demolding device 23 and before the filling device 22. With the aid of this arrangement, molds can be cleaned during the operation of the molding apparatus. Alternatively, the mold cleaning device 1" is located before the demolding device 23. In this embodiment it is only possible to clean the molds when the molds 2 are not filled by the filling-device 22.

The invention claimed is:

1. Device (1) for cleaning a mold (2), in particular for molds (2) which are used to produce lipstick leads, each mold (2) defining an upper opening (5), said device comprising:

a nozzle (6) extending through the upper opening (5) and into the mold (2) and defining a first opening (3) for inserting steam into the mold (2) to be cleaned;

at least one second opening (4) disposed around the nozzle (6) for collecting the steam and, where applicable, residues from the mold (2) to be cleaned; and an exhaust socket (8) in fluidic communication with the at least one second opening (4) for exhausting the steam and, where applicable, the residues collected by the at least one second opening (4);

wherein the device is disposed over the upper opening (5) of the mold (2) and closes the upper opening (5) of the mold (2) in an air tight manner when steam is being inserted into the mold (2).

2. Device (1) for mold cleaning according to claim 1, wherein the nozzle (6) is inserted into a lower part of the mold (2) to be cleaned.

3. Device (1) for mold cleaning according to claim 1, further comprising means for sucking off with which the steam and, where applicable, the residues are sucked off through the at least one second opening.

4. Device (1) for mold cleaning according to claim 1 wherein the nozzle (6), the first opening (3), and the second opening (4) are assembled as one part.

5. Molding apparatus for molding materials by using a mold (2) defining an upper opening (5), in particular for molding lipstick leads, said molding apparatus comprising:

a filling device (22) for filling the mold (2);

a demolding device (23) for demolding said molded material out of the mold (2);

a device (1) for cleaning the mold, said device including a nozzle (6) extending through the upper opening (5) and into the mold (2) and defining a first opening (3) for inserting steam into the mold (2) to be cleaned, at least one second opening (4) disposed around the nozzle (6) for collecting the steam and, where applicable, residues from said mold (2) to be cleaned, and an exhaust socket (8) in fluidic communication with the at least one second opening (4) for exhausting the steam and, where applicable, the residues collected by the at least one second opening (4), wherein the device is disposed over the upper opening (5) of the mold (2) and closes the upper opening (5) of the mold (2) in an air tight manner when steam is being inserted into the mold (2).

6. Molding apparatus according to claim 5, wherein said device (1) for mold cleaning is located with respect to a moving direction (21) of the molds (2) in said molding apparatus after said demolding device (23) and before said filling device (22).

7. Molding apparatus according to claim 5 wherein the the nozzle (6), the first opening (3), and the second opening (4) of the device (1) are assembled as one part.

* * * * *